US011389809B2

(12) United States Patent
Hundertmark et al.

(10) Patent No.: US 11,389,809 B2
(45) Date of Patent: Jul. 19, 2022

(54) SELF-EMPTYING SEPARATOR FOR THE GENTLE DISCHARGE OF SHEAR-SENSITIVE PRODUCTS, AND METHOD FOR OPERATING SAME

(71) Applicant: GEA MECHANICAL EQUIPMENT GMBH, Oelde (DE)

(72) Inventors: Tim Hundertmark, Gütersloh (DE); Mario Emanuele, Oelde (DE); Alexander Piek, Oelde (DE); Jürgen Mäckel, Oelde (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 297 days.

(21) Appl. No.: 16/498,540

(22) PCT Filed: Mar. 8, 2018

(86) PCT No.: PCT/EP2018/055726
§ 371 (c)(1),
(2) Date: Sep. 27, 2019

(87) PCT Pub. No.: WO2018/177710
PCT Pub. Date: Oct. 4, 2018

(65) Prior Publication Data

US 2020/0038882 A1 Feb. 6, 2020

(30) Foreign Application Priority Data

Mar. 29, 2017 (DE) ..... 10 2017 106 801.5

(51) Int. Cl.
*B04B 7/04* (2006.01)
*B04B 1/12* (2006.01)
(Continued)

(52) U.S. Cl.
CPC ..... *B04B 7/04* (2013.01); *B04B 1/12* (2013.01); *B04B 1/14* (2013.01); *B04B 11/02* (2013.01); *B04B 11/04* (2013.01)

(58) Field of Classification Search
CPC .... B04B 7/04; B04B 1/12; B04B 1/14; B04B 11/02; B04B 11/04; B04B 1/10
(Continued)

(56) References Cited

U.S. PATENT DOCUMENTS 3,145,172 A * 8/1964 Thylefors ..... B04B 11/02 494/27
4,008,098 A * 2/1977 Dietzel ..... B04B 11/02 127/19
(Continued)

FOREIGN PATENT DOCUMENTS

DE 2550496 A1 5/1977
DE 2755130 A1 6/1979
(Continued)

OTHER PUBLICATIONS

International Search Report dated May 16, 2018 in related/corresponding International Application No. PCT/EP2018/055726.
(Continued)

*Primary Examiner* — Walter D. Griffin
*Assistant Examiner* — Shuyi S. Liu
(74) *Attorney, Agent, or Firm* — Patent Portfolio Builders PLLC

(57) ABSTRACT

A self-emptying separator includes a rotatable drum with an inlet, a liquid outlet, outlet openings for solid material, and a control system. A flowable starting product is cleared of the solids in continuous operation in a centrifugal field in the rotating drum. A continuous discharge of a clear phase is performed. A solid phase is discharged via the outlet openings from a solids collecting space of the drum into an
(Continued)

Figure 1:
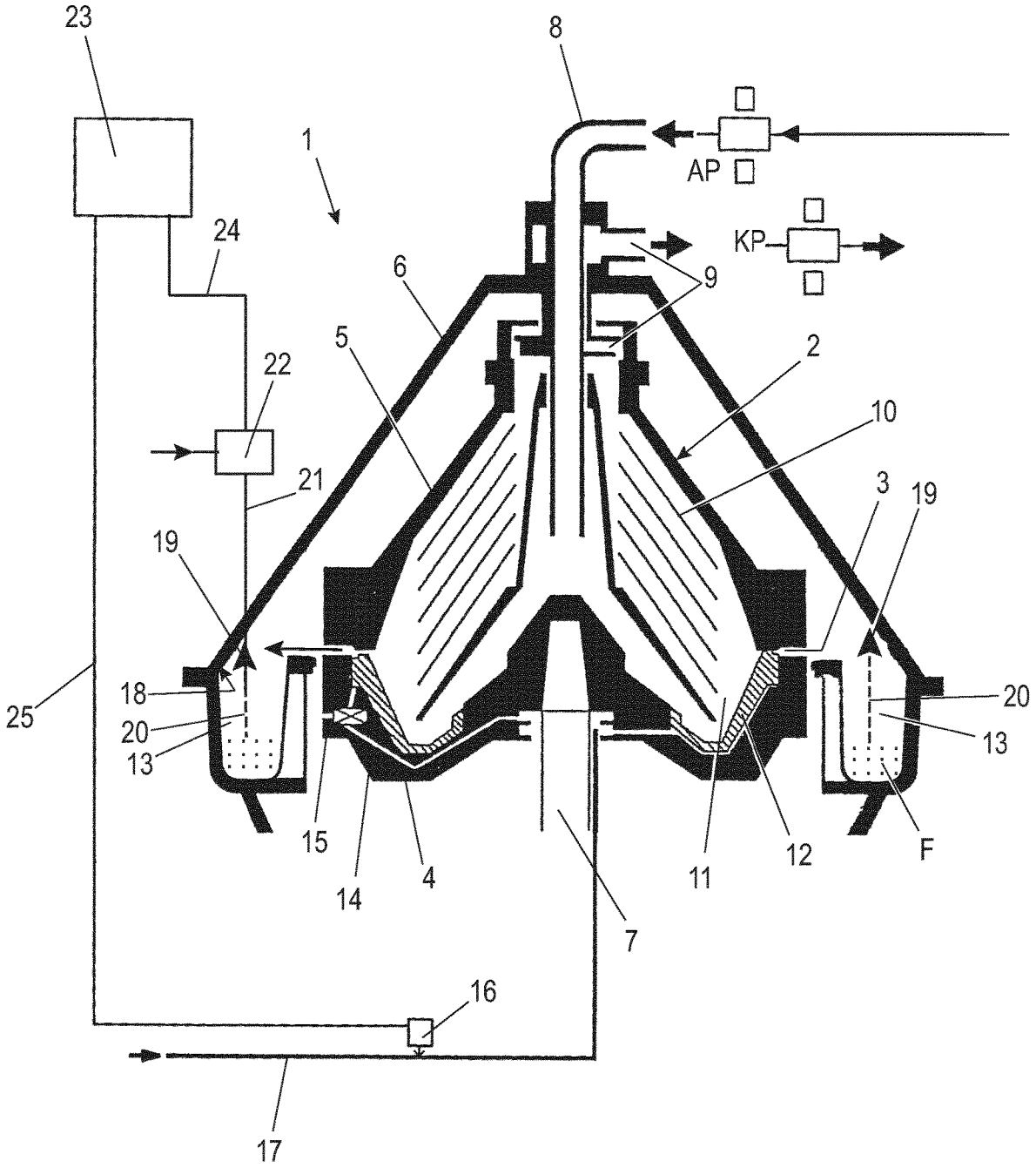

annular solids catcher. The solids catcher has a device for generating a fluid curtain against which the solids, issuing from the outlet openings for solid material, impact.

9 Claims, 3 Drawing Sheets

(51) Int. Cl.
*B04B 1/14* (2006.01)
*B04B 11/02* (2006.01)
*B04B 11/04* (2006.01)

(58) Field of Classification Search
USPC ..... 494/5, 15, 27, 36, 56, 60, 10, 30
See application file for complete search history.

(56) References Cited

U.S. PATENT DOCUMENTS 10,040,076 B2 8/2018 Mackel et al.
2004/0176233 A1 9/2004 Himmen et al.
2016/0263586 A1* 9/2016 Mackel ..... B04B 11/04

FOREIGN PATENT DOCUMENTS

DE 102013111576 A1 4/2015
WO 03008105 A1 1/2003

OTHER PUBLICATIONS

Search Report dated Feb. 7, 2018 in related/corresponding DE Application No. 10 2017 106 801.5.
Written Opinion dated May 16, 2018 in related/corresponding International Application No. PCT/EP2018/055726.

* cited by examiner

SELF-EMPTYING SEPARATOR FOR THE GENTLE DISCHARGE OF SHEAR-SENSITIVE PRODUCTS, AND METHOD FOR OPERATING SAME

BACKGROUND AND SUMMARY OF THE INVENTION

Exemplary embodiments of the invention relate to a self-emptying separator for the gentle discharge of shear-sensitive products and a corresponding method.

Self-emptying separators are used for clarifying a product to be processed of materials having higher specific weight—referred to as solids hereafter—and are known from the prior art. These separators comprise a rotatable drum having a feed, at least one liquid outlet, solid discharge openings to be opened and closed discontinuously or continuously open solid outlet openings, and a control unit. The solid outlet openings typically open into a ring chamber, which is also referred to as a solid collector.

In the processing of sensitive products, for example, algae, fermentation broths, or other biogenic products, the solids to be discharged possibly have to be prevented during the discharge from the separator into the solid collector, because of the strong momentum acting on the solid, from being permanently damaged or even destroyed in their structure. It is thus to be ensured in these cases that the forces acting on the solid upon impact of the solid on a baffle wall of the solid collector are reduced.

A self-emptying separator is described in WO 03/008105 A1. The separator comprises a solid collector having a ring-shaped baffle wall. The baffle wall is designed so that the discharged solid covers a defined distance along a curved path before it is conducted out of the solid collector. In this way, a gentle and low-shear deflection of the solid out of the solid outlet openings into the solid collector is to take place.

Against this background, exemplary embodiments of the invention are directed to refining a self-emptying separator in another way such that a gentle and low-destruction solid discharge is possible using it.

According to exemplary embodiments of the invention, the solid collector comprises a device for producing a fluid curtain, on which the solids exiting from the outlet openings for solids impact, before they could impact on a fixed wall in the solid collector. The momentum of the exiting solid is thus advantageously at least partially dissipated upon the impact on the fluid curtain so that the solid discharge into the solid collector takes place gently and with low shear. A method for operating a separator is accordingly provided, using which a product to be processed is clarified of solid in a centrifugal field in the drum, which solid is emptied out of the drum continuously or discontinuously through outlet openings, and in which at least during the emptying of the solids, a fluid curtain is produced, on which the solids exiting from the outlet openings for solids impact.

In one preferred embodiment variant of the invention, the device for producing a fluid curtain comprises openings, in particular nozzles, which are distributed on the circumference of the solid collector and using which the fluid curtain is producible. It is thus advantageously ensured that the required components for a gentle and low-shear solid discharge can be arranged on a separator or can even be retrofitted easily and without refitting of the solid collector. The fluid curtain is preferably produced in such a way that it extends cylindrically or conically around the drum or at least concentrically like a sleeve around the solid discharge openings thereof during the solid discharge.

In one preferred embodiment variant, the solid collector comprises a baffle wall, which is arranged behind the curtain in the flight direction of the solid. The separator can optionally be used with or without fluid curtain in this way.

It is expedient for the fluid curtain to be formed along the entire circumference of the solid collector in front of a baffle wall.

According to one variant, the fluid curtain can be used on a separator that discontinuously empties the solid or according to another variant it can be used on a separator that continuously empties the solid. The fluid curtain is an advantageous supplementation for both variants.

In a further preferred embodiment variant of the invention, water can be used as the fluid forming the fluid curtain. The fluid curtain is thus a water curtain made of liquid water.

This is advantageous since a water hydraulic system is also provided for an actuation of a piston slide valve, which opens and closes the discharge openings of a separator having discontinuous solid discharge and since in this way a further hydraulic part can be provided easily for supplying the openings, in particular nozzles, for producing the fluid curtain.

The use of the starting product to be processed or its obtained clear phase as a fluid for the fluid curtain is also advantageous, since mixing of the solid with an additional fluid does not occur in this way.

To dilute the discharged solid as little as possible, the fluid curtain can first be switched on shortly before the emptying $Time_{on}<10$ seconds and/or can be switched off again directly after the emptying $Time_{off}<10$ seconds.

If it is a solid of which no residues are to remain in the solid collector, the value for $Time_{off}$ can also be significantly extended $Time_{off}<10$ minutes to ensure flushing of the solid out of the solid collector.

BRIEF DESCRIPTION OF THE DRAWING FIGURES

Figure 2:
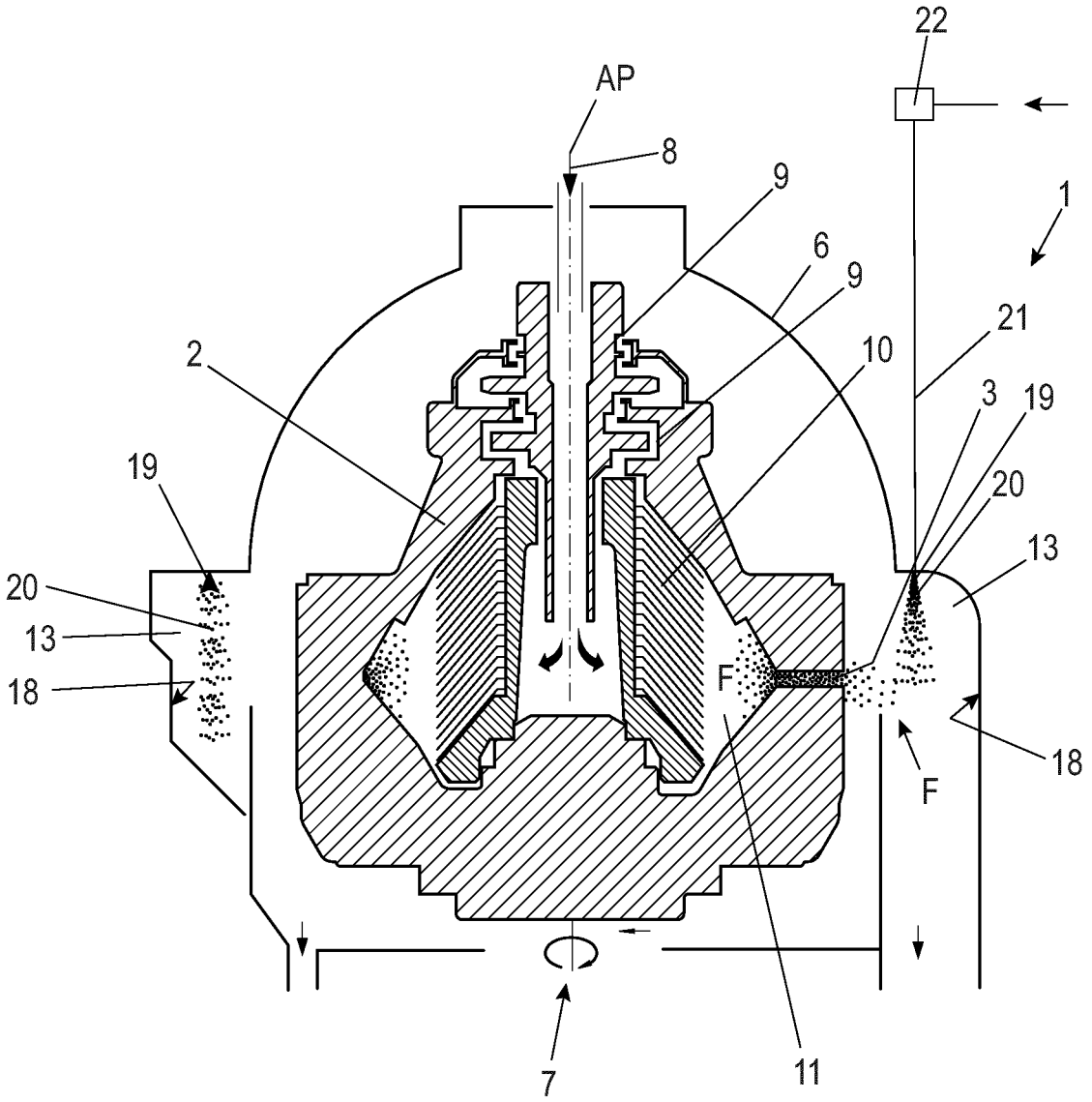

The invention will be explained in greater detail hereafter on the basis of a preferred exemplary embodiment with reference to the appended drawings. In the figures:

FIG. 1: shows a schematic sectional view of a self-emptying separator according to the invention having discontinuous solid discharge;

FIG. 2: shows a schematic sectional view of a self-emptying separator according to the invention having continuous solid discharge.

Figure 3:
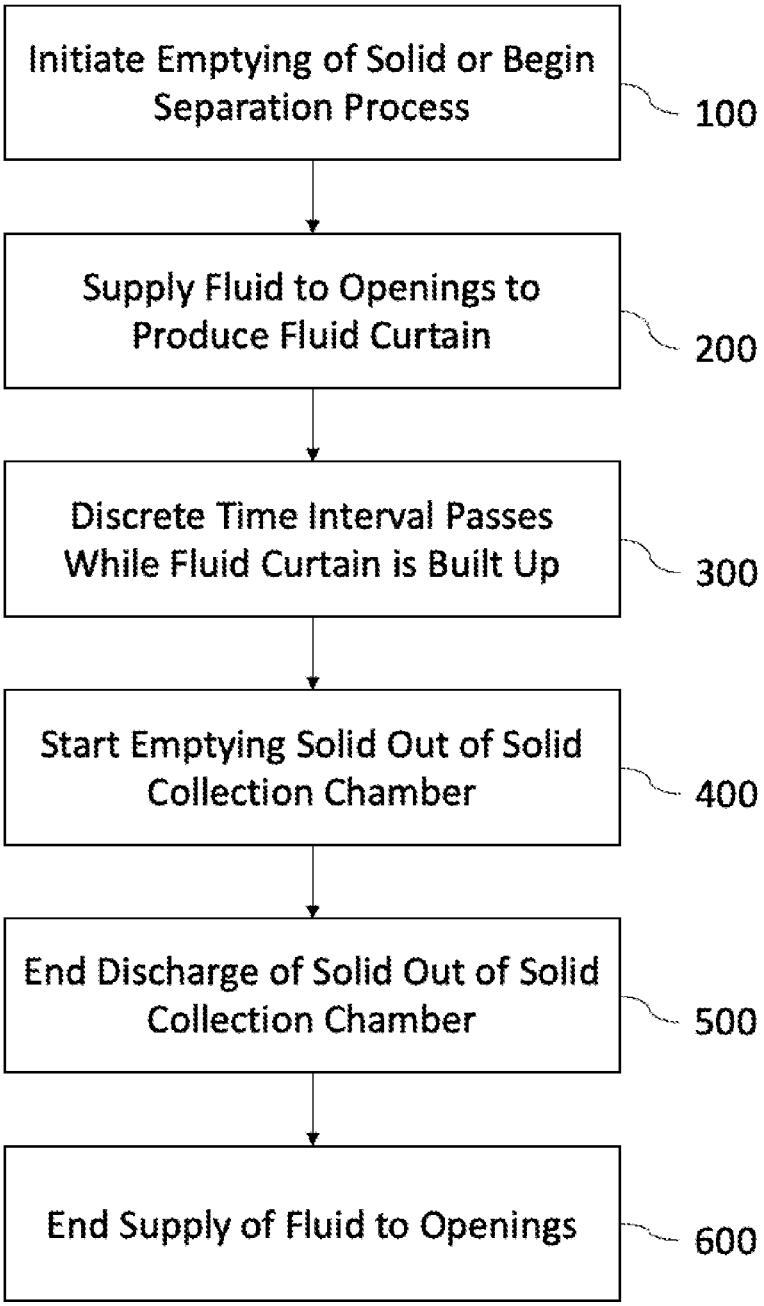

FIG. 3: shows a schematic flow chart of the method according to the invention.

DETAILED DESCRIPTION

FIG. 1 shows a separator 1 for clarifying solid-containing, free-flowing starting products AP having a rotatable drum 2 with a vertical axis of rotation. The processing of the starting product AP takes place in continuous operation. The separator 1 is a self-emptying separator 1.

This means that the feed of the starting product AP takes place continuously and the drainage of at least one clarified liquid phase, called clear phase KP, also takes place continuously. The drum 2 of the separator 1 has in the embodiment as a self-emptying separator 1 a solid outlet, which is discontinuous here, wherein the solid F separated from the starting product AP by clarification is removed at intervals here by the opening and re-closing of outlet nozzles or outlet openings 3.

The drum 2 comprises a drum lower part 4 and a drum cover 5. It is furthermore preferably enclosed by a hood 6. The drum 2 is moreover placed on a drive spindle 7, which is rotatably mounted and drivable by a motor.

The drum 2 comprises a product feed 8, through which the starting product AP is conducted into the drum 2. Furthermore, it comprises at least one drain 9—provided with a gripper—which is used to drain a clear phase KP out of the drum 2. The gripper—also referred to as a peeling disk—is a centripetal pump. The drain 9 can also be produced structurally in another manner and/or using other means. Moreover, it is also conceivable to also perform a separation of the starting product AP into two liquid phases of different densities in addition to the clarification. A further liquid drain is then required for this purpose.

The drum 2 preferably comprises a plate stack 10 made of axially spaced-apart separating plates. A solid collection chamber 11 is formed between the outer circumference of the plate stack 10 and the inner circumference of the drum 2 in the region of its largest internal diameter. Solids that are separated from the clear phase in the region of the plate stack 10 collect in the solid collection chamber 11, from which the solids F can be discharged out of the drum 2 via outlet openings 3.

The outlet openings 3 can be opened and closed for this purpose here by means of a piston slide valve 12, which is arranged in the drum lower part 4 and is displaceable therein parallel to the axis of rotation (in particular vertically). With open outlet openings 3, the solid F is let out of the drum 2 into a solid collector 13.

The drum 2 comprises an actuating mechanism for moving the piston slide valve 12. It comprises here at least one feed line 14 for a control fluid, for example, water, and a valve arrangement 15 in the drum 2 and further elements outside the drum 2. The feed of the control fluid via a metering arrangement 16 arranged outside the drum 2 is thus enabled, which is associated with a feed line 17 for the control fluid arranged outside the drum 2, so that the control fluid can be introduced into the drum 2 for solid emptying of the solid F by releasing the valve arrangement 15 or vice versa the inflow of control fluid can be interrupted to move the piston slide valve 12 accordingly in order to release the outlet openings 3.

The solid collector 13 comprises a device for producing a fluid curtain 20, on which the solids F exiting from the outlet openings 3 for solid F impact.

The solid collector 13 furthermore comprises at least one radially outer baffle wall 18, preferably in relation to the axis of rotation. The device for producing a fluid curtain 20 comprises multiple, preferably four or more openings—in particular nozzles 19—which can be arranged distributed angularly spaced-apart—preferably uniformly—on the circumference of the solid collector 13. The fluid curtain 20 is located radially inward in relation to the baffle wall 18.

In this case, the number of the openings, in particular nozzles, 19 is dependent on the diameter of the drum 2 and is advantageously selected so that the fluid curtain 20 is produced by the openings, in particular nozzles 19, in such a way that it is advantageously formed along the entire circumference of the solid collector 13 in front of its baffle wall 18. The momentum of the exiting solid F is thus advantageously at least partially dissipated upon impacting on the fluid curtain 20.

The fluid curtain 20 is preferably sprayed from top to bottom in the axial direction with vertical axis of rotation. The openings 19 are then preferably distributed on an upper wall of the solid collector or on an adjoining component such as a hood and the exit end thereof is preferably oriented axially substantially downward. The fluid curtain 20 is preferably cylindrical or conical in the produced state. However, it can also, for example, enclose the drum in a peripherally-closed polygonal shape. For this purpose, the openings 19 are preferably distributed on an upper wall of the solid collector and the exit end thereof is oriented downward.

The openings, in particular nozzles, 19 are preferably formed so that the exiting fluid exits like a fan, i.e., the fluid jet is narrow radially in relation to the axis of rotation of the drum, the fluid jet is wide perpendicularly thereto in order to cover the entire circumference inside the solid collector with a fluid curtain 20 using the fewest possible openings, in particular nozzles. In order to produce this fan-like exit, the nozzle can be provided with a slotted exit opening or alternatively with multiple exit openings in the direction of the fluid curtain to be produced.

The effectiveness of the fluid curtain can be set by the quantity/time of the fluid used in dependence on the sensitivity of the product to be processed. The more fluid is used, the denser the fluid curtain becomes and the more strongly the momentum of the exiting solid is dissipated. For this purpose, the quantity/time of the fluid can be regulated in the final control element 22 by the opening cross section of a valve being changed therein. Alternatively, the pressure of the fluid in the line 21 can be changed, or also the cross-sections of the openings can be adapted in the openings, in particular nozzles 19.

The openings, in particular nozzles, 19 can conduct the fluid from above into the solid collector, as shown in FIG. 1 and FIG. 2, alternatively this is also possible from the bottom or tangentially from the direction of the baffle wall 18.

The fluid forming the fluid curtain 20 is preferably water. This is advantageous since a water hydraulic system can also be provided for the actuation of the piston slide valve 12 and parts of this hydraulic system are thus usable in multiple ways. However, this is not required.

Alternatively/optionally, the use of the starting product to be processed or its obtained clear phase as a fluid for the fluid curtain is also advantageous, since in this way mixing of the solid with an additional fluid does not occur.

The supply of the fluid takes place via a corresponding line 21. The line 21 can be blocked and opened by a control pulse by a final control element 22.

To dilute the discharged solid as little as possible, the fluid curtain 20 can first be switched on shortly before the emptying of the solid. The switching on time before the emptying can thus be "$Time_{on}$<10 seconds". The fluid curtain is preferably switched off again directly after the emptying. Preferably: "$Time_{off}$<10 seconds" applies, since the fluid curtain is not required again until the next emptying.

If this involves a solid of which no residues are to remain in the solid collector, the value for $Time_{off}$ can also be significantly lengthened $Time_{off}$<10 minutes, to ensure flushing of the solid out of the solid collector.

If it has proven to be advantageous for conducting the solids out of the solid collector, for example in the case of sticky or adhesive solids, the fluid curtain can also be permanently activated.

A gentle and low-shear momentum dissipation of the solid F exiting out of the outlet openings 3 of the separator 1 into the solid collector 13 is enabled in a simple and advantageous manner by the fluid curtain 20 extending in front of the baffle wall 18.

It is furthermore advantageous that the components 19, 21, 22 required for this purpose can be retrofitted easily and without refitting of the solid collector 13 on a separator 1. In addition, the construction variant management of the separator 1 is simplified, since the variant of the solid collector 13 for a gentle solid discharge is formed simply and thus advantageously by the conventional variant of the solid collector 13 plus the openings, in particular nozzles, 19.

The control processes and/or control pulses described here are controlled and/or coordinated by a control device 23. The control device 23 is connected for this purpose via data connections 24, 25, which are embodied here by way of example by voltage-conducting and/or signal-conducting lines and/or cables, to the final control elements or valves 16, 21. The data connections 24, 25 can alternatively be implemented by other suitable active principles, for example, by bridging the signal distance by way of high-frequency radiation, for example radio signals.

To avoid repetitions, only differences, modifications, or additions to the separator 1 according to FIG. 1 are described for the separator 1 in FIG. 2.

Contrary to the separator 1 according to FIG. 1, the separator 1 according to FIG. 2 operates as a self-emptying separator 1 having a continuous solid outlet. Accordingly, the drum 2 of the separator 1 has a continuous solid outlet here, wherein the solid F separated from the starting product AP by clarification is permanently removed here through the outlet nozzles or outlet openings 3. A piston slide valve 12 having the corresponding positioning elements and feed lines is accordingly not required here.

In FIG. 2, the openings, in particular nozzles, 19, which produce the fluid curtain 20 in front of the baffle wall 18 of the solid collector 13 are shown so they are well visible. The solid collector 13 comprises a line here, using which the solid F is removed from the solid collector 13. For this reason, the solid collector 13 has two different geometries in the sectional illustration shown in FIG. 2—wherein the section is located through the drain line.

An exemplary embodiment of a product clarification method, which can be carried out using the above-described separator 1, will be explained in greater detail hereafter on the basis of the figures.

The starting product AP is preferably continuously conducted into the drum 2 of the separator, where it is clarified. A continuous clear phase outlet of the clear phase KP takes place.

During the clarification of the starting product AP to form the clear phase KP, turbid substances and other solids F contained in the starting product AP are collected in the solid collection chamber 11 of the drum 2 outside the plate stack 10, which fills up.

In a discontinuously emptying separator 1, the discharge of the solid F out of the drum 2 through the outlet openings 3 into the solid collector 13 is initiated depending on defined parameters, while in a continuously emptying separator 1, the discharge of solid F takes place permanently after starting the separation process.

For the gentle and low-shear emptying of solid F out of a separator 1 according to the invention, which empties the solid F discontinuously or continuously, the following method is specified:

The method—see FIG. 3—starts in step 100. In step 100, the emptying of the solid F out of the solid collection chamber 11 of the separator is initiated or, in a continuously emptying separator 1, the separation process is begun, respectively.

Thereafter, in a further step 200, the supply of fluid to the openings, in particular nozzles, 19 to produce the fluid curtain 20 in front of the baffle wall 18 of the solid collector 13 is started by a control pulse to the final control element 22.

In a following step 300, a defined, discrete time interval passes, which is determined in accordance with the emptying duration and can be, for example, one to ten, particularly preferably three to five seconds. The fluid curtain is built up.

In a further step 400, the emptying of the solid F out of the solid collection chamber 11 of the separator is started by a control pulse on the metering assembly 16 and the valve assembly 15, if the separator is a discontinuously emptying separator according to FIG. 1. In a continuously emptying separator, the emptying of the solid F begins directly after the separation process has been started and the time interval in step 300 has passed.

In a following step 500, the discharge of solid F out of the solid collection chamber 11 is ended by a control pulse to the metering assembly 16 and the valve assembly 15. In a continuously emptying separator, the emptying of the solid F only ends when the separating process is ended.

In a final step 600, the supply of fluid to the openings, in particular nozzles, 19 for producing the fluid curtain 20 in front of the baffle wall 18 of the solid collector 13 is ended by a control pulse to the final control element 22.

Overall, using the method described and claimed, a gentle and low-shear emptying of solid F out of a separator 1 according to the invention, which empties the solid F discontinuously or continuously, is ensured in a simple and thus advantageous manner.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 separator
2 drum
3 outlet opening
4 drum lower part
5 drum cover
6 hood
7 spindle
8 feed
9 drain
10 plate stack
11 solid collection chamber
12 piston slide valve
13 solid collector
14 feed line

15 valve arrangement
16 metering arrangement
17 hydraulic line
18 baffle wall
19 opening
20 fluid curtain
21 supply line
22 final control element
23 controller
24 data connection
25 data connection
KP clear phase
AP starting product
F solid

The invention claimed is:

1. A self-emptying separator, comprising:

a rotatable drum having a vertical axis of rotation;

a feed;

at least one liquid drain;

outlet openings for solids;

a piston slide valve configured to open and close the outlet openings; and a controller, wherein a free-flowing starting product is clarified of the solids in continuous operation in a centrifugal field in the rotatable drum, wherein a clear phase is emptied continuously and a solid phase is emptied from a solid collection chamber of the rotatable drum into a ring-shaped solid collector discontinuously via the outlet openings, wherein the solid collector comprises a device for producing a fluid curtain, on which the solid phase exiting from the outlet openings for solid impact, wherein the device for producing a fluid curtain comprises openings that are distributed on an upper wall of the ring-shaped solid collector or on an adjoining component, the openings of the device for producing a fluid curtain have exit ends that are axially oriented downward, wherein the openings of the device for producing the fluid curtain are nozzles, which are distributed on a circumference of the solid collector, wherein the separator is configured to discontinuously empty the solids, wherein the controller is configured to control a position of the piston slide valve and supply of fluid to the nozzles so that the fluid curtain is produced for a first period of time while the piston slide valve is in a first position that closes the outlet opening, the fluid curtain continues to be produced for a second period of time while the piston slide valve is in a second position that opens the outlet openings, and the fluid curtain stops being produced after passage of a third period of time after the piston slide valve returns to the first position.

2. The self-emptying separator of claim 1, wherein at least four or more nozzles are distributed on the circumference of the solid collector.

3. The self-emptying separator of claim 1, wherein the solid collector comprises a baffle wall.

4. The self-emptying separator of claim 3, wherein the fluid curtain is formed along an entire circumference of the solid collector in front of the baffle wall.

5. The self-emptying separator of claim 1, wherein a fluid forming the fluid curtain is water.

6. The self-emptying separator of claim 1, the free-flowing starting product or the clear phase obtained from the starting product to be processed is a fluid forming the fluid curtain.

7. The self-emptying separator of claim 1, wherein a supply line supplies the fluid to the nozzles, wherein the supply line is openable and closeable by a final control element.

8. The self-emptying separator of claim 7, wherein the controller is connected to the final control element via data connections.

9. A method for operating a separator, the method comprising:

rotating a rotatable drum having a vertical axis of rotation;

supplying a free-flowing starting product into the rotatable drum to separate the free-flowing product into a clear phase and a solid phase;

continuously emptying the clear phase from the rotatable drum;

producing, via nozzles distributed in an upper wall of a ring-shaped solid collector or an adjoining component for a first period of time, a fluid curtain on which the solid phase exiting the outlet openings impact, wherein a piston slide valve is in a first position covering outlet openings for solids of the separator during the first period of time;

moving the piston slide valve from the first position to a second position in which the piston slide valve does not cover the outlet openings for solids and emptying the solid phase from the rotatable drum into the ring-shaped solid collector while the piston slide valve is in the second position, wherein the nozzles continue to produce the fluid curtain while the piston slide valve is in the second position;

moving, after a second period of time, the piston slide valve from the second position to the first position, wherein the nozzles stop producing the fluid curtain after passage of a third period of time after the piston slide valve is moved from the second position to the first position.

* * * * *